United States Patent [19]

Belanger et al.

[11] Patent Number: 5,026,187

[45] Date of Patent: Jun. 25, 1991

[54] DISPENSER FOR HOT-MELT MATERIAL

[76] Inventors: Richard A. Belanger, Lamprey Rd, R.D. 1, Box 802, Kensington, N.H. 03827; Peter S. Melendy, 11 Crestview Dr., Exeter, N.H. 03833; Robert L. Ornsteen, 1405 Washington St., Key West, Fla. 33040

[21] Appl. No.: 196,774

[22] Filed: May 17, 1988

Related U.S. Application Data

[63] Continuation of Ser. No. 889,519, Jul. 25, 1986, abandoned.

[51] Int. Cl.[5] ..... B67D 5/62

[52] U.S. Cl. ..... 401/1; 222/146.2; 222/146.5; 401/2

[58] Field of Search ..... 401/1, 2; 222/146.2, 222/146.5

[56] References Cited

U.S. PATENT DOCUMENTS

| | | | |
|---|---|---|---|
| 1,409,616 | 3/1922 | Taddeo | 401/182 |
| 1,769,437 | 7/1930 | Kromer, Jr. | 222/146.5 X |
| 3,430,816 | 3/1969 | Nadherny et al. | 222/146.5 |
| 3,443,059 | 5/1969 | Spencer | 401/2 X |
| 4,065,034 | 12/1977 | Callen | 222/146.5 |
| 4,067,481 | 1/1978 | Feldman | 222/146.5 |
| 4,320,857 | 3/1982 | Herb et al. | 222/146.5 |

FOREIGN PATENT DOCUMENTS

| | | | |
|---|---|---|---|
| 729851 | 8/1932 | France | 401/1 |
| 2090921 | 7/1982 | United Kingdom | 222/146.2 |

*Primary Examiner*—Steven A. Bratlie

*Attorney, Agent, or Firm*—Berman, Aisenberg & Platt

[57] ABSTRACT

A dispenser for hot-melt materials, such as adhesives, includes a heat-conductive, removable cartridge containing the adhesive to be melted, a chamber for receiving the cartridge and a heater adjacent the cartridge for melting the adhesive prior to dispensing through a nozzle. Pressure is applied through a plunger to expel the adhesive through the nozzle.

9 Claims, 1 Drawing Sheet

DISPENSER FOR HOT-MELT MATERIAL

This application is a continuation of Ser. No. 889,519, filed July 25, 1986, now abandoned.

FIELD OF THE INVENTION

The invention relates to hot melt glue guns.

BACKGROUND OF THE INVENTION

In prior art glue guns a stick of solid adhesive, without a casing, is advanced through the gun either by manual pressure, or mechanically. One glue stick is used to push the remains of an earlier stick through the glue gun. Severe limitations exist as to the types of glue which may be used in this type of gun, since most hot melt glue formulas cannot combine the requirement of stick stiffness with properties that maximize the adhesive qualities of the glue. Furthermore, changing the type of glue in the glue gun requires the previous adhesive to be removed from the melt chamber because supplying a different type of adhesive to the melt chamber produces a blended glue which often has properties inferior to those of either of its components.

Cohen U.S. Pat. No. 3,459,335, Siwon U.S. Pat. No. 4,463,877, Steinel U.S. Pat. No. 4,493,972, Dziki U.S. Pat. No. 4,457,457, Cooper U.S. Pat. No. 3,281,576, Juffa U.S. Pat. No. 3,199,740, and Newton U.S. Pat. No. 3,776,426 show prior glue guns each having the disadvantage of using a rod of adhesive, without a casing, in which the formulation of the adhesive is severely limited by the necessity for the rod to be rigid. Also these glue guns include, the requirement of cleaning one glue out of the melt chamber before inserting a glue stick of a different formulation. Further prior art includes MacKinnon U.S. Pat. No. 2,626,085, which describes a grease gun having a plunger for expelling grease from the gun. A caulking gun, such as that shown in DeHart U.S. Pat. No. 3,636,378, dispenses caulk from a cartridge at ambient temperature.

SUMMARY OF THE INVENTION

An adhesive dispenser is provided in which the adhesive is contained in a removable, heat-conductive cartridge. The cartridge is placed in a dispenser having a heating element which heats the cartridge and melts the adhesive in the cartridge. A plunger applies pressure to one end of the cartridge to advance the melted adhesive through the cartridge whereby it is dispensed through a nozzle mechanism.

An object of the invention is to provide an adhesive dispenser in which the adhesive is contained in a heat conductive cartridge.

Another object of the invention is to provide an adhesive dispenser in which the adhesive containing cartridge may readily be changed for a cartridge containing a different type of adhesive without intermixing of the different adhesives.

Still another object of the invention is to provide an adhesive dispenser in which the adhesive is melted rapidly.

A further object of the invention is to provide an adhesive dispenser in which the adhesive is dispensed from a cartridge by action of a plunger.

DETAILED DESCRIPTION OF THE INVENTION

Figure 1:
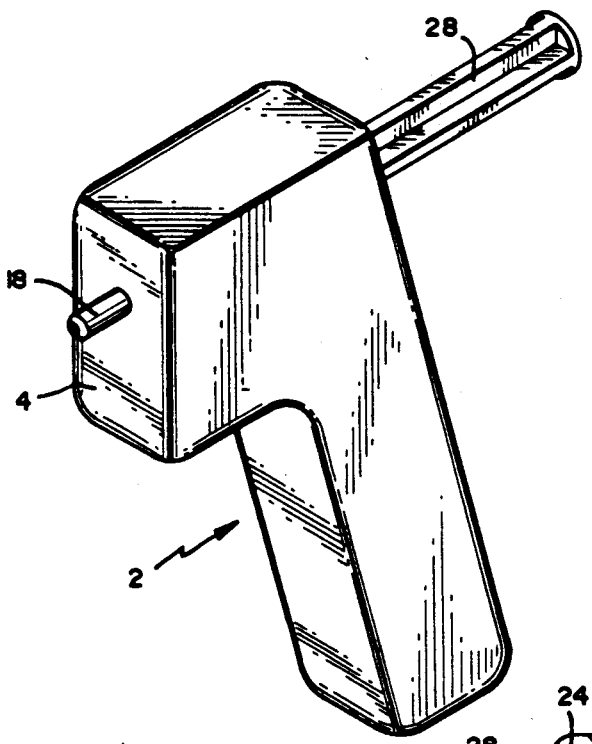
FIG. 1 shows a perspective view of a dispenser of the invention.
Figure 3:
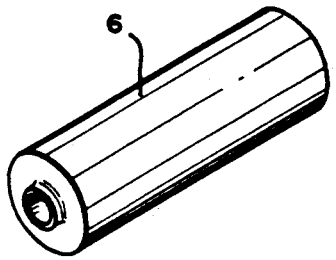
FIG. 3 shows a perspective view of a cartridge useful in the dispenser of FIG. 1.
Figure 2:
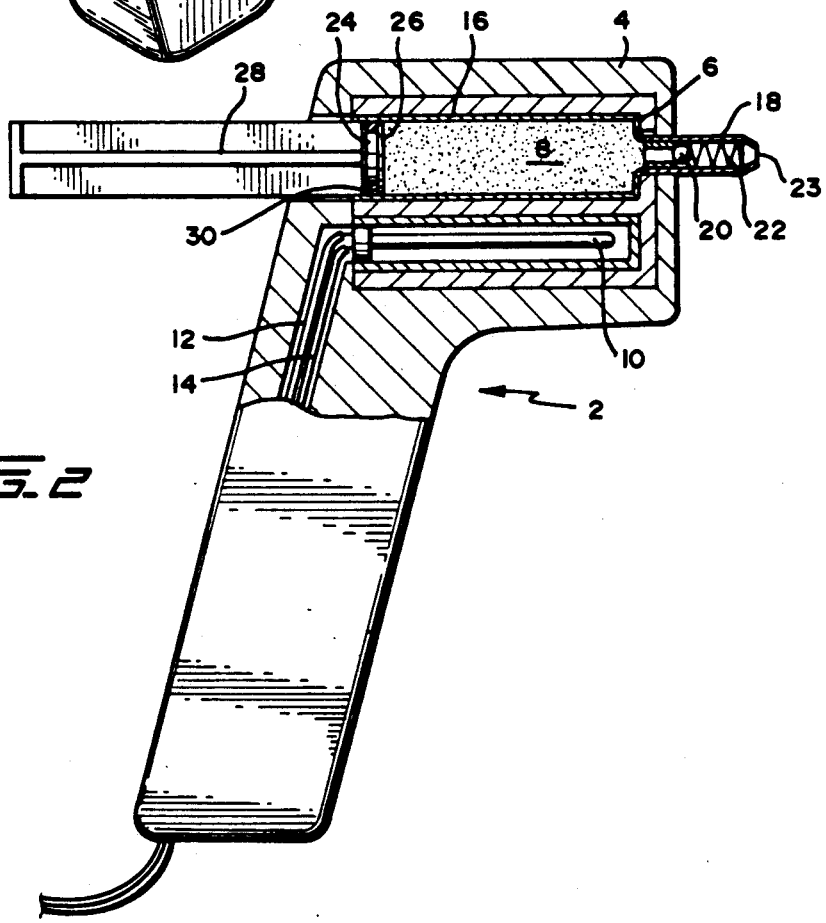
FIG. 2 shows a side view, partly in cross-section, of the dispenser of FIG. 1.

Referring to FIGS. 1 to 3, in which like numerals represent similar parts, dispenser 2 has a housing 4 in which cartridge 6, which contains hot-melt material 8, is placed. Cartridge 6 is made of heat-conductive material, for example, metal. The cartridge contains hot-melt material, such as adhesive, to be dispensed. Inside dispenser 2 is a PTC heating device 10, well known in the art, for heating the cartridge and its contents. Ceramic or metal-sheathed cartridge heaters may also be used. A PTC heating device is particularly efficient, and allows cartridge 6, which is encased in heat-conducting material, to be rapidly and evenly heated. Leads 12, 14, connect PTC heater 10 to a source of electricity. The cartridge is slidingly received in melt chamber 16 which is in thermal contact with the PTC heater.

Cartridge 6 slides into melt chamber 16 in dispenser 2 and contacts nozzle 18 which may conveniently include a ball check valve or alternate valve system to control material flow. The ball check valve comprises ball 20 adjacent spring 22, the valve being opened upon pressure of plunger 24 on lid 26 of cartridge 6, thus allowing the hot-melt material to exit through nozzle outlet 23. Cartridge 6 has a casing of metal, or other heat-conducting material, and a separate lid 26, the lid being pushed along the body of cartridge 6 by pressure from plunger 24 to which handle 28 is attached. The plunger may act simply by pressure on lid 26, or a plunger/-ratchet combination may be provided in which the pressure on lid 26 may be maintained until the rachet mechanism is released. To prevent seepage of melted material 8 around plunger 24, a seal, such as O-ring 30, is provided in the plunger mechanism, as is known in the art.

In use, the cartridge is placed in the receiving chamber in the dispenser, the heater is energized, and the material in the cartridge is melted. Pressure on the plunger causes the lid of the cartridge to be pressed inward, thus causing melted material to be extruded through the nozzle. To change the cartridge, the plunger is retracted, the cartridge is removed, and a different cartridge (also having a heat-conducting casing), which may contain a different type of hot-melt material, is placed in the dispenser, and is similarly melted and extruded from the nozzle.

In another embodiment of the dispenser of the invention the nozzle assembly is an integral part of the cartridge, so that when changing the type of material being applied the cartridge with attached nozzle is removed and another cartridge with its own attached nozzle is inserted in the dispenser. This eliminates any problem which might occur from mixing different types of material in the nozzle, and allows for using different sizes and/or types of nozzle according to the material being dispensed.

In yet another embodiment, the cartridge is manufactured integrally with the plunger mechanism, so that in use a cartridge and plunger are inserted into the dispenser, and removed after use.

In still another embodiment, the nozzle mechanism, the cartridge, and the plunger may all be integrally combined and inserted together into the dispenser for use. Different combinations may be removed and inserted at will.

With the device of the invention, the material to be melted, generally adhesive material, is not limited to one which can maintain sufficient stiffness to be formed into a rod, since the adhesive is contained in a heat-conducting cartridge. Thus, the adhesive can be more broadly formulated than hitherto possible. The cartridge, for example, a metal tube, can be hermetically sealed from the atmosphere, which allows the use of several high performance adhesives which are sensitive to atmospheric conditions and not generally usable in the form of a glue stick for a prior art glue gun. Examples of these adhesives are polyamide adhesives, moisture cure hot-melt urethanes, cyanoacrylates, epoxy adhesives, and acrylic adhesives.

Polyamide adhesives have very high bond strength but are hygroscopic and absorb moisture. When a polyamide adhesive that has absorbed moisture is heated to its normal application temperature of 350° F., the moisture is vaporized, and foaming of the hot melt adhesive results. Using a cartridge of the invention, moisture is prevented from reaching the polyamide adhesive, and foaming cannot occur.

Hot melt urethane adhesives have unique bonding characteristics in that they exhibit initial hot melt "green strength", but these adhesives react with surface moisture on the parts being bonded and in 24 to 48 hours increase their bond strengths to a level approaching that of epoxy and cyanoacrylate adhesives. Moisture cure hot melt urethanes are not suitable for use in prior art glue guns, but may be used in cartridges of the invention. Cyanoacrylate adhesives are also moisture sensitive and may be used in the system of the invention.

The hot-melt cartridge has several unexpected advantages. Heat transfer through the conductive casing of the cartridge provides rapid heating of small amounts of hot-melt material, thus allowing the dispenser to be used very soon after a cold start-up. This attribute enables the dispenser of the invention to be used as a quick-fix repair gun.

Since the cartridges are self-contained, a cartridge may easily be removed from the tool and another cartridge inserted in its place, allowing cartridges to be custom designed for specific applications. A cartridge may contain, for example, plastic adhesive, metal adhesive, wood filler, or conductive solder material. The user simply removes one cartridge and inserts another. Different hot-melt materials are readily used, and this is particularly convenient where at least two of the plunger, cartridge and nozzle are integrally combined.

The PTC heating unit is well known in the art, and one type of PTC heater is described in Steinel U.S. Pat. No. 4,493,972. Heaters of this type are self-regulating, simple to operate, and well known to one skilled in the art, who is also aware of the temperature to which each type of adhesive or other material needs to be raised in order to become molten for use in the dispenser described herein.

The cartridges may conveniently be ½" in diameter and 2" to 4" in length, the cartridge casing appropriately being made from metal or other material of relatively high thermal conductivity. While cartridges may generally be of cylindrical shape, it is conceivable that virtually any shape which allows economical manufacture and ease of use could be made available. The ball check valve adjacent the tip of the cartridge, providing controlled flow of the cartridge contents, is similar to nozzles of prior art glue guns. The shape of the nozzle may be different from that illustrated in the FIGS. 1 to 3, according to the nature and use of the material to be dispensed. The plunger seal, illustrated as an O-ring, must be a pressure seal capable of sealing at least the resultant force exerted by the nozzle spring on the fluid in the cartridge. Without a seal, the glue would be able to leak past the seal, and enter the tool, possibly short-circuiting the heater, or simply contaminating the tool with adhesive. Silicone O-rings may suitably be used as the interface seal due to low cost, ability to withstand heat up to 400° F., and ease of installation. Another alternative is to use a plastic molded plunger, or other plunger, in which the seal is integrally formed. After use, the cartridge is a disposable item. If the cartridge has been only partially used, it may be removed, stored, and subsequently replaced in the tool for reheating and use until empty.

It will be appreciated that the melt chamber in which the cartridge is contained should be closely the same diameter as the cartridge in order to allow a sliding fit of the cartridge into the melt chamber to provide for good heat transfer to the cartridge in order to melt its contents readily.

Warm up time is minimal and may be as little as one minute, because no non-heated interface is needed. Heating is through conductive materials, and is rapid. Generally, the tool is economical of electricity since heat is conducted through generally heat-conductive materials.

The adhesive dispenser of the invention, including the plunger, nozzle, and other parts, may be made in any convenient configuration, and may be made of metal, plastic, or other material known in the art. While the invention has been described above with respect to certain embodiments thereof, it will be appreciated that variations and modifications may be made without departing from the spirit and scope of the invention.

What is claimed is:

1. A dispenser for an air or moisture sensitive adhesive material to be melted comprising heat conductive cartridge means comprising a hermetically sealed chamber storing said material to be melted and preventing contact of said material with air or moisture, heat conductive chamber means receiving the cartridge means, heating means for melting the material stored in the cartridge means, outlet means communicating with the cartridge means for dispensing the melted material and plunger means for advancing the melted material into the outlet means, said cartridge means, chamber means and heating means being in thermal contact with each other, wherein said material stored in said chamber is an adhesive selected from the group consisting of polyamide adhesives, moisture cure hot melt urethane, cyanoacrylate, epoxy adhesive, and acrylate adhesives.

2. A dispenser of claim 1 wherein the cartridge means comprises a heat-conductive casing.

3. A dispenser of claim 2 wherein the heat-conductive casing is a metal casing.

4. A dispenser of claim 1 wherein the cartridge means further comprises plunger means.

5. A dispenser of claim 1 wherein the outlet means comprises valve means.

6. A dispenser of claim 5 wherein the valve means comprises a ball valve.

7. A dispenser of claim 1 wherein the plunger means comprises pressure sealing means.

8. A dispenser of claim 7 wherein the pressure sealing means comprises an O-ring.

9. A cartridge for a hot melt material dispensing device comprising a heat conductive casing containing said hot melt material and adapted to be received in a heating chamber, outlet means communicating with the interior of said casing for allowing melted material to be dispensed, and plunger means for forcing melted material through said outlet means, said casing, outlet means, and plunger means being hermetically sealed to prevent the introduction of air or moisture into said hot melt material, and wherein said hot melt material is an adhesive selected from the group consisting of polyamide adhesives, moisture cure hot melt urethane, cyanoacrylate, epoxy adhesive, and acrylic adhesives.

* * * * *